United States Patent [19]

Schulze-Beckinghausen

[11] Patent Number: 4,895,056

[45] Date of Patent: Jan. 23, 1990

[54] TONG AND BELT APPARATUS FOR A TONG

[75] Inventor: Jorg Schulze-Beckinghausen, Garbsen, Fed. Rep. of Germany

[73] Assignee: Weatherford U.S., Inc., Houston, Tex.

[21] Appl. No.: 276,697

[22] Filed: Nov. 28, 1988

[51] Int. Cl.[4] ..... B25B 17/00

[52] U.S. Cl. ..... 81/57.17; 81/57.33

[58] Field of Search ..... 81/57.17, 57, 57.14, 81/57.33, 57.15, 57.43

[56] References Cited

U.S. PATENT DOCUMENTS

| | | | |
|---|---|---|---|
| 1,422,302 | 7/1922 | Parker | 81/57.33 |
| 1,481,157 | 1/1924 | Smith | 81/57.17 |
| 1,702,822 | 2/1929 | Ferguson | 81/57.15 |
| 2,509,688 | 5/1950 | Loosli | 81/57 |
| 2,650,070 | 8/1953 | Lundeen | 255/35 |
| 2,879,680 | 3/1959 | Beeman et al. | 81/53 |
| 3,023,651 | 3/1962 | Wallace | 81/57 |
| 3,180,186 | 4/1965 | Catland | 81/57.18 |
| 3,261,241 | 7/1966 | Catland | 81/57.18 |
| 3,540,326 | 11/1970 | Dickmann et al. | 81/57 |
| 3,799,010 | 3/1974 | Guier | 81/57 |
| 3,875,826 | 4/1975 | Dreyfuss et al. | 81/57.18 |
| 3,892,140 | 7/1975 | Fox et al. | 74/224 |
| 3,906,820 | 9/1975 | Hauk | 81/57.17 |
| 4,079,640 | 3/1978 | Golden | 81/57.17 |
| 4,084,453 | 4/1978 | Eckel | 81/57.18 |
| 4,092,881 | 6/1978 | Jurgens et al. | 81/57.34 |
| 4,099,429 | 7/1978 | Hauk | 81/57.17 |
| 4,167,128 | 9/1979 | Chandler et al. | 81/66 R |
| 4,170,907 | 10/1979 | Cathcart | 81/57.11 |
| 4,170,908 | 10/1979 | Peveto et al. | 81/57.11 |
| 4,192,206 | 3/1980 | Schulze-Beckinghausen | 81/57.18 |
| 4,212,212 | 7/1980 | Chandler et al. | 81/57.17 |
| 4,266,450 | 5/1981 | Farr et al. | 81/57.33 |
| 4,273,010 | 6/1981 | Farr et al. | 81/57.18 |
| 4,280,397 | 7/1981 | Peveto | 91/452 |
| 4,290,304 | 9/1981 | Eckel | 73/862.25 |
| 4,346,629 | 8/1982 | Kinzbach | 81/57.2 |
| 4,445,402 | 5/1984 | Farr | 81/57.16 |
| 4,471,674 | 9/1984 | Doss | 81/57.17 |
| 4,512,216 | 4/1985 | Callegari et al. | 81/57.17 |
| 4,604,922 | 8/1986 | Soutsos | 81/57.17 |
| 4,688,453 | 8/1987 | Schulze-Beckinghausen | 81/57.18 |
| 4,774,860 | 10/1988 | Hauke | 81/57.17 |

FOREIGN PATENT DOCUMENTS

| | | | |
|---|---|---|---|
| 480401 | 1/1952 | Canada | 81/57.15 |
| 175902 | 10/1965 | U.S.S.R. | 81/57.17 |
| 457593 | 3/1975 | U.S.S.R. | 81/57.33 |
| 489626 | 10/1975 | U.S.S.R. | 81/57.33 |

OTHER PUBLICATIONS

1988–1989 General Services and Products catalog Weatherford (pp. 4108; 4094–4096; 4112–4121) Weatherford Power Equipment.

*Primary Examiner*—James G. Smith
*Attorney, Agent, or Firm*—Guy McClung

[57] ABSTRACT

A tong having a flexible belt and an anchor member for it. A belt assembly for mounting, disposing, and moving a flexible belt in a tong or in the rotary of tongs having rotary elements. One embodiment of such a tong for rotating a tubular member according to the present invention has a housing; a rotary element in the housing which is either turned manually or power driven; mount plates (which can also serve as brake plates) disposed within the housing and movable therein with respect to the rotary element and, upon the action of other member, movable with the rotary element; an anchor assembly mounted to the mount plates; the anchor assembly having an exterior cam surface; a belt carrier movably mounted to the rotary element; the belt carrier having a cam follower for contacting and following the cam surface of the anchor assembly; a flexible belt extending from the anchor assembly to the belt carrier, the belt being tightened around the tubular as the rotary and belt carrier rotate to the point where a portion of the belt is wrapped around the tubular and the belt carrier's cam follower has moved to contact the cam surface of the anchor assembly, and the anchor assembly and mount plates then move with the rotary to rotate the tubular. An anchor assembly with an exterior cam surface. A belt holder for holding a belt and for tightening it.

19 Claims, 4 Drawing Sheets

TONG AND BELT APPARATUS FOR A TONG

BACKGROUND OF THE INVENTION

1. Field of the Invention

This invention is directed to tongs, anchor members for tong belt apparatuses, for tongs for rotating an object such as a tubular member and particularly to the field of tongs employing such members and apparatus.

2. Description of the Prior Art

Gripping elements or jaws used in conventional tongs are designed to operate with very high load variations between leading and trailing dies. Jaw guiding slides or linkages are used to control die contact and force delivery. Jaw guides absorb energy and detract from torque delivery. Uneven die loading causes marring or damage to the tubular surface.

In some designs die loading becomes increasingly asymmetrical as pipe size is reduced, substantially increasing die wear and the probability of damage. A power tong should preferably be able to cover a range of pipe sizes without difficulty, and if a further pipe size change is needed, it should be effected with only an interchange of parts. Maintenance and life problems can have an economic significance far in excess of the cost of the dies or even the pipe involved, because the down time that results when replacements or repair must be made involves not only material costs, but also drilling rig and crew costs and the continuing charges for other specialized tools and equipment present at the drilling rig. Thus a power tong system which requires frequent replacement of dies or other elements or which causes undue damage to sections in a pipe string would be far inferior to a power tong system which operates steadily and uniformly.

Both jaw/die tongs and belt/chain tongs can be used with relatively hard and rigid metal tubulars such as casing and tubing. When these tongs are used with thin tubulars or tubulars made from relatively "softer" metals or from premium metals such as high alloy steels or low carbon steels or tubulars made from non-metal materials such as fiber glass, they often literally chew up the tutular.

When working with fiber glass reinforced pipe, serrated or toothed dies (or jaws with such dies) can easily cause marking or damage to tubulars. Such damage results in destruction of reinforcing filaments in the tubular and can considerably reduce the tubular's strength. When the outside surfaces of the fiber glass pipe are irregular or outside diameters of individual joints vary, either inadequate or extreme die penetration is achieved.

U.S. Pat. No. 4,774,860, co-assigned with this application, addressed these problems and taught a new tong which can and has been successfully used with softer tubulars such as fiber glass pipe. The present invention, in one embodiment, teaches an improvement of and simplification of the tongs and apparatuses of U.S. Pat. No. 4,774,860.

SUMMARY OF THE INVENTION

The present invention is directed to a tong having a flexible belt, to a belt assembly for mounting, disposing and moving such a flexible belt in a tong, and to a unique belt holding device which, in one embodiment, can tighten the belt. One embodiment of a tong for rotating a tubular member according to the present invention has a housing; a rotary element movable in the housing; mount plates (which can also serve as brake plates) disposed within the housing and moveable therein with respect to the rotary element and, upon the action of other members, moveable with the rotary element; an anchor member or assembly having an exterior cam surface mounted to the mount plates; a belt carrier mounted to the rotary element having a cam follower for moving along the cam surface of the anchor member; a flexible belt extending from the anchor assembly to the belt carrier, the belt being tightened around the tubular as the rotary and belt carrier rotate to the point where a portion of the belt is wrapped around the tubular and the belt carrier has moved to contact the anchor assembly so that the tubular can be rotated.

In one embodiment a unique belt holding and tightening apparatus is provided for securing the belt to the anchor member. The flexible belt can be any suitable flexible material which will produce the necessary torque for the type and size of tubular being rotated, such as a belt made from metal, plastic, nylon, woven material, delrin, or aramid fiber material such as KEVLAR (Registered Trademark) material.

To provide preloading, brake means can be provided to coact with the mount means to which the anchor assembly is mounted. The brake force must be overcome before the mount can move. Before the braking force is overcome, there is enough force to wrap the belt around the tubular sufficiently quickly and tightly enough that slippage is reduced or prevented, then the belt has sufficient frictional contact with the pipe to begin to turn it.

A belt carrier is disclosed according to this invention which is secured to the anchor member and includes a flanged shaft, the flanges having recesses for receiving a key which extends through the recesses and a loop in the belt to secure the belt to the anchor member. In one embodiment the shaft is rotatable with the key to take up slack in the belt.

It is, therefore, an object of this invention to provide a new, useful, unique, and nonobvious rotative device such as a tong with a flexible belt which can efficiently rotate a tubular member. It is also an object of the present invention to provide a new, useful, unique, and nonobvious belt assembly for such a device and processes for using it.

An additional object of the present invention is the provision of such a tong in which a portion of the belt is wrapped around a tubular to be rotated and held tightly enough so that sufficient friction is developed to rotate the tubular.

A further ojbect of the present invention is the provision of a tong utilizing a flexible belt which will not damage or deform tubulars made of relatively fragile, weak, or thin materials; for example, soft metals, premium alloys, composites, fibers, plastics or fiber glass.

Another object of this invention is the provision of a belt assembly for a tong and a tong with such an assembly which has an anchor assembly with an exterior cam surface which coacts with a cam follower on a belt carrier movably mounted to a tong rotary element, the camming action serving to tighten the belt around a tubular to be rotated and, in one embodiment, to hold the cam follower during tubular rotation.

A particular object of the present invention is to provide such a tong which has a belt made from woven nylon or aramid material such as KEVLAR (Registered Trademark).

A further object of this invention is the provision of belt holding and tightening apparatus for securing a belt to a tong anchor assembly.

Another object of the present invention is the provision of a tong having easily accessible and easily manipulable belt-tightening members.

To one of skill in this art who has the benefit of this invention's teachings other and further advantages and objects will be clear from the description of preferred embodiments when taken in conjunction with the accompanying drawings.

DESCRIPTION OF PRESENTLY PREFERRED EMBODIMENTS

Figure 1:
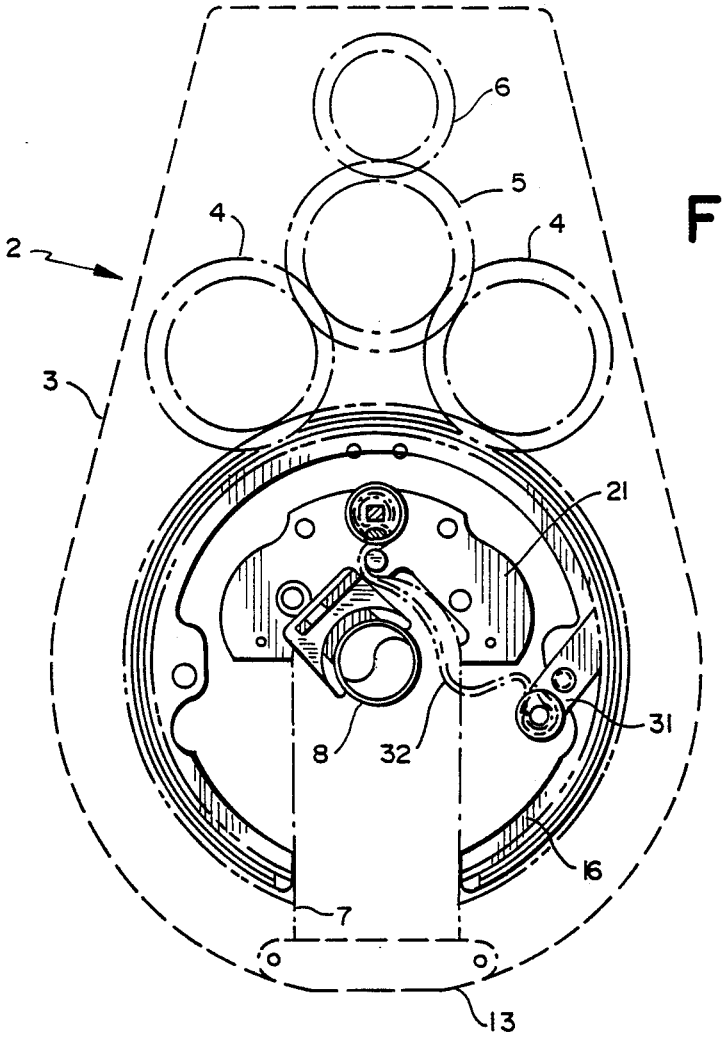
FIG. 1 is a top plan view, partially cutaway of a tong according to the present invention with its top mount plate removed and its housing and drive gears shown in outline.

Referring to FIG. 1, a tong 2 has a tong housing 3 (shown in outline) and drive elements including idler gears 4, an intermediate gear 5, and a drive gear 6. An opening 7 in the tong housing 3 is provided for receiving a pipe 8 to be rotated. The pipe 8 is shown centered in the tong 2. The gears mesh with and turn a rotary element 16. Conventional drive means, not shown, drives gear 6.

A gate 13 is pivotably mounted across the opening 7 to close it off during use.

A belt anchor assembly 21, a belt 32 and a belt carrier assembly 31 are disposed within the tong 2. The belt apparatus in combination with other tong parts provides the means for wrapping the belt 32 about the pipe 8 in a non-symmetrical configuration with respect to the longitudinal axis of the pipe and the corresponding axis of the tong 2.

Figure 2:
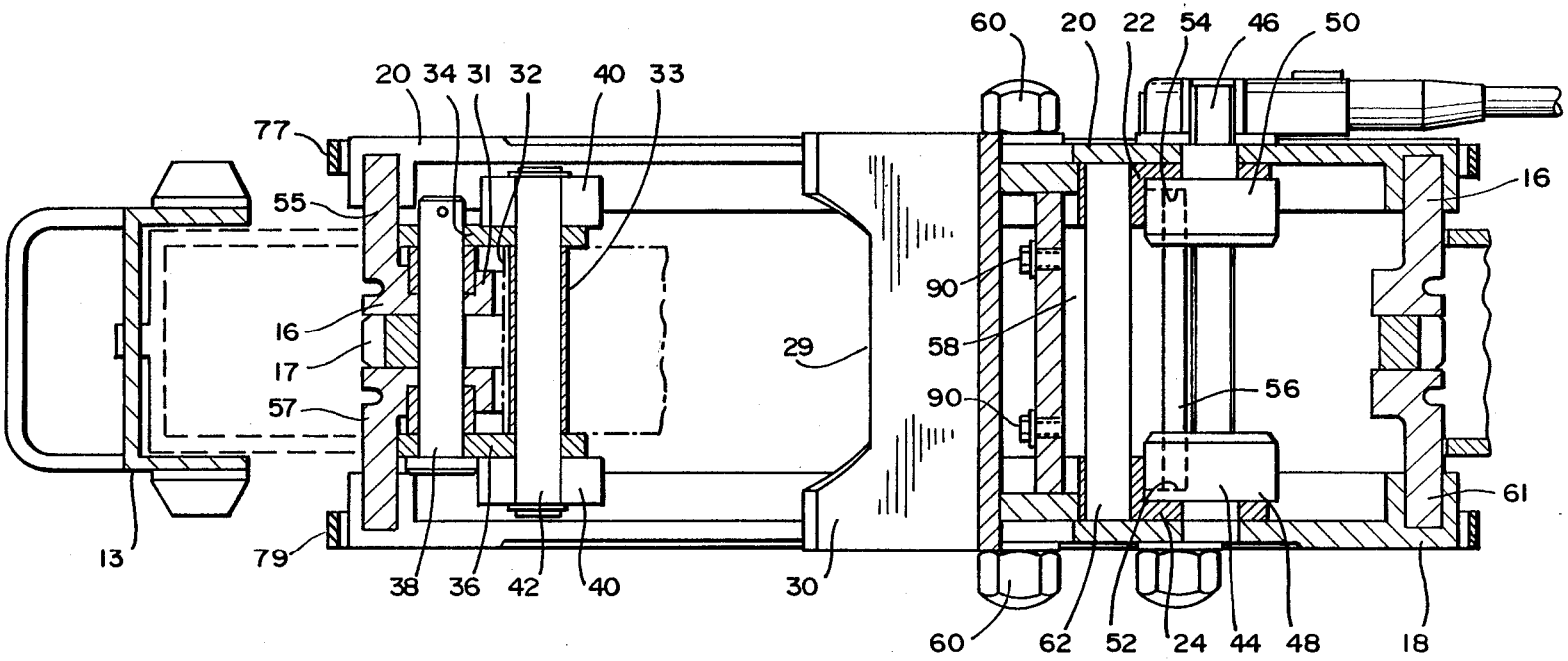
FIG. 2 is a side view of the tong of FIG. 1 partially in crosssection.

As shown in FIG. 2, the belt anchor assembly 21 is connected to mount plates or brake plates 18, 20 which in turn are acted upon by braking apparatus such as conventional band brakes 77, 79. It is this braking force which the rotary element 16 must overcome to move the anchor assembly 21. Once this force is overcome the rotary element 16, belt 32, belt carrier assembly 31, and belt anchor assembly 21 will move in unison and cause the pipe 8 to rotate.

FIG. 2 presents a side crosssectional view of the apparatus of FIG. 1. FIG. 2 illustrates the belt anchor assembly 21 and belt carrier assembly 31 in relation to the tong case 2, the rotary element 16, and the brake plates 18, 20. The anchor assembly 21 is bolted to a top mount brake plate 20 and to a bottom mount brake plate 18. Braking action on the plates 18, 20 is provided by conventional braking means such as band brakes 77, 79.

Referring further to FIG. 2, a top rotary guide 55, rotary element 17, and bottom rotary guide 57 are bolted together in a conventional manner. The mount brake plates 18, 20 move on the rotary guides 55, 57 and carry with them the anchor assembly 21. A top anchor assembly plate 22 is bolted to the top mount brake plate 20. The bottom anchor assembly plate 24 is bolted to the bottom mount brake plate 18.

A jaw 30 with a portion 29 for the belt is bolted with bolts 90 to spacer bolts 58 which pass through holes 66 in anchor assembly plates 22 and 24. A recess 84 receives a rear housing 35 of the jaw 30. A piece, pieces, or a coating of rubber, plastic, granular or other high friction material 64 may be applied to the interior of jaw 30 for better holding of the pipe 8.

The belt carrier assembly 31 has top (34) and bottom (36) pivot arms which are movably connected to the rotary 16 with the pivot pin 38 through a hole 74 and are spaced apart so that the belt 32 can pass between them. Cam bearings 40 are rotatably mounted at the ends of a pin 42 which is mounted through the pivot arms 34, 36. The cam bearings are disposed so that they can follow cam surfaces which they encounter.

A belt shaft assembly 44 is mounted through the anchor assembly plates 22, 24 and include a belt anchor shaft 46 having upper (50) and lower (48) flanges between which the belt 32 can pass and which serve to correctly position the belt 32. Each flange 50, 48 has a keyway therein 54, 52 respectively for receiving a key 56 for holding a loop of the belt 32. An idler shaft 62 makes it possible for more of the belt to contact the pipe 8.

Figure 7:
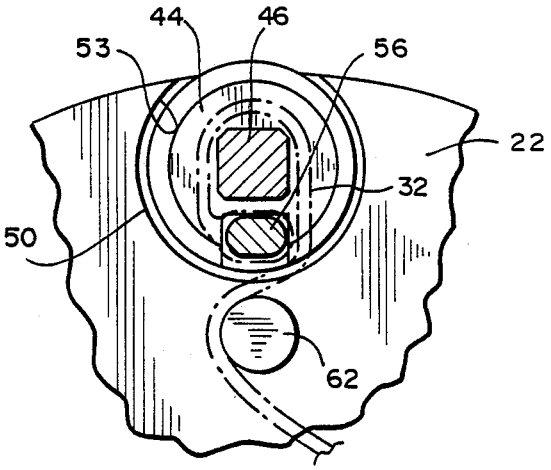
FIG. 7 is a top plan view of a belt holding apparatus (also shown in FIGS. 1 and 2) according to the present invention.
Figure 8:
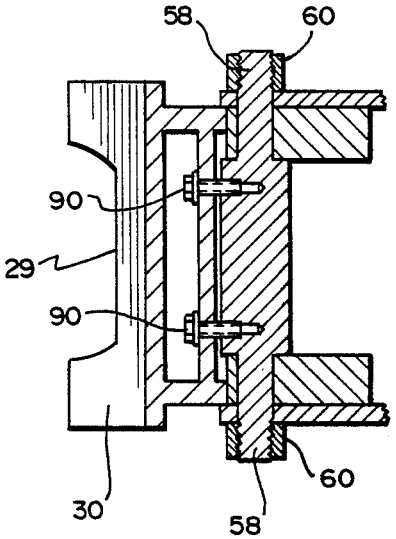
FIG. 8 is a side view in crosssection of the mounting of the jaw in the tong of FIG. 1

The assembly 44 serves to hold and tighten the belt 32. As shown in FIG. 7, retention of a loop of the belt 32 in the anchor assembly is accomplished by the keyways 54, 52 into which the key 56 is inserted. The assembly 44 sits in an opening 53 in the anchor assembly. Quick removal and replacement of the belt 32 is facilitated by rotating the rotary 16 so that the opening 82 in the rotary reveals the key 56 and the belt 32. The belt is then unwound off the rotating shaft 46, and the shaft 46 is rotated so that the radial keyways face the opening 82. The belt end and key are then removed. A new belt is added by placing the key in the end of the belt, then sliding said key (with belt attached) into the keyways and rotating the shaft 46 so that the key is retained circumferentially by the keyways and radially by the opening 53. The opposite end of the belt 32 is disengaged from the belt carrier assembly by removing pin 38 which allows removal of the belt carrier assembly and thereby easy removal and replacement of the belt.

Figure 3:
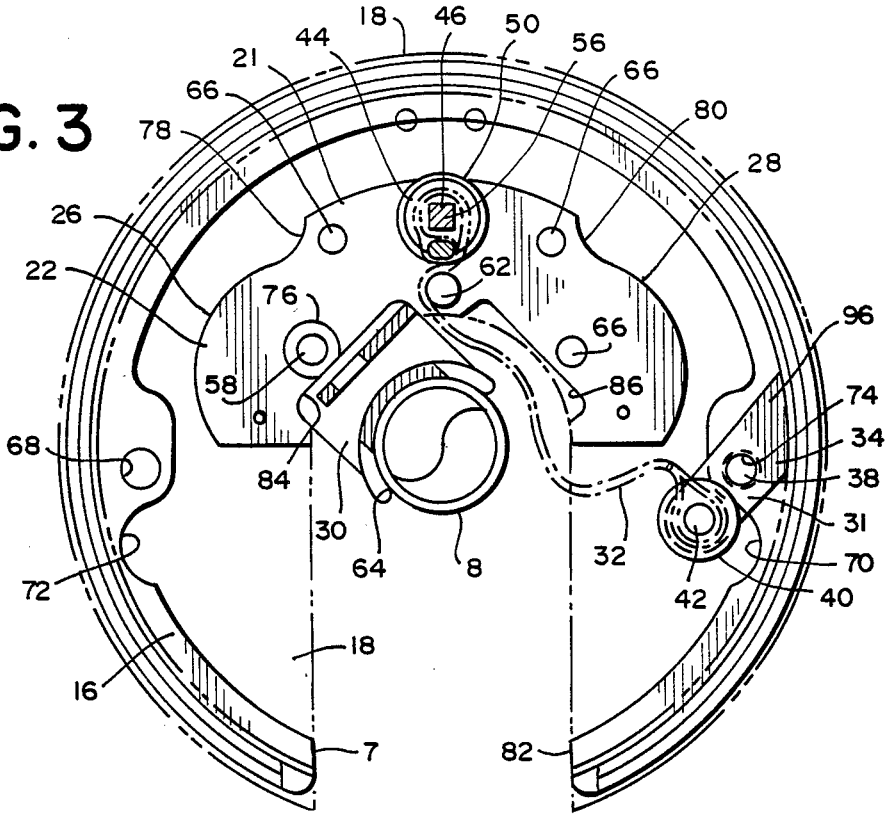
FIGS. 3–6 are top plan views showing operative portions of the tong of FIG. 1 during various stages of rotation about a tubular.
Figure 4:
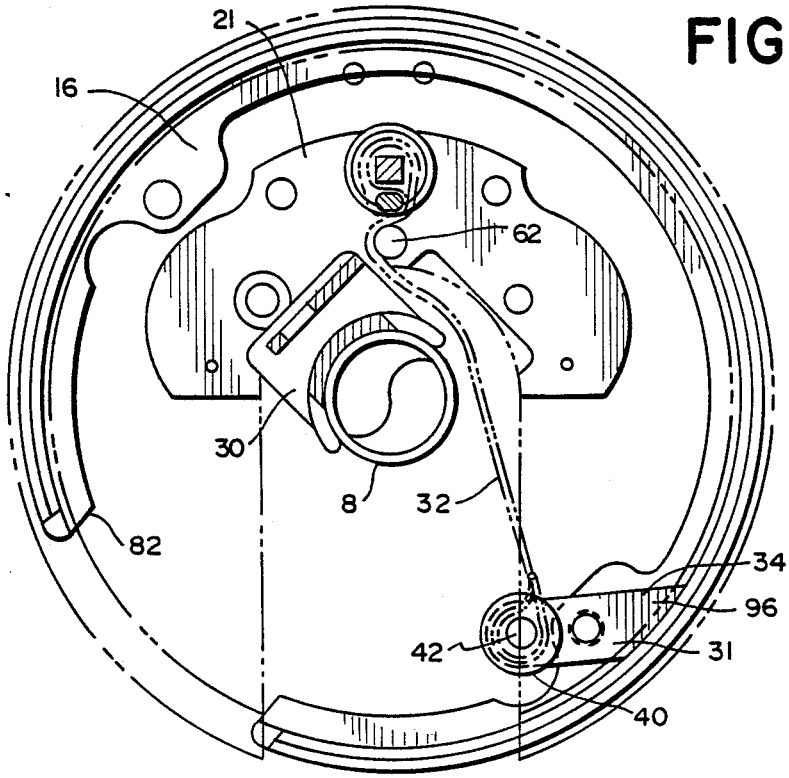

As shown in FIG. 3, the belt 32 is relatively loose and limp. FIG. 4 illustrates the location of the belt after a slight clockwise rotation of the rotary element 16. The belt 32 is not yet in contact with the exterior surface of the pipe 8. The anchor assembly has not yet moved.

Figure 5:
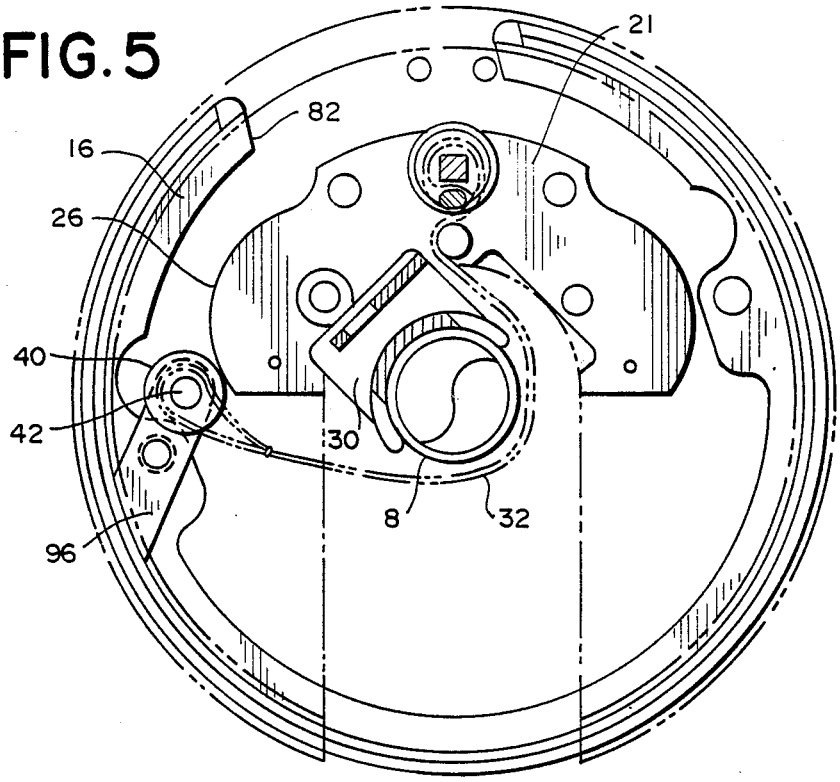

Referring now to FIG. 5, the rotary element 16 has moved further in a clockwise direction, the belt 32 is is not yet contacting the pipe 8. The cam bearings 40 have contacted and started to follow cam surfaces 26 of the anchor assembly plates 22, 24.

Figure 6:
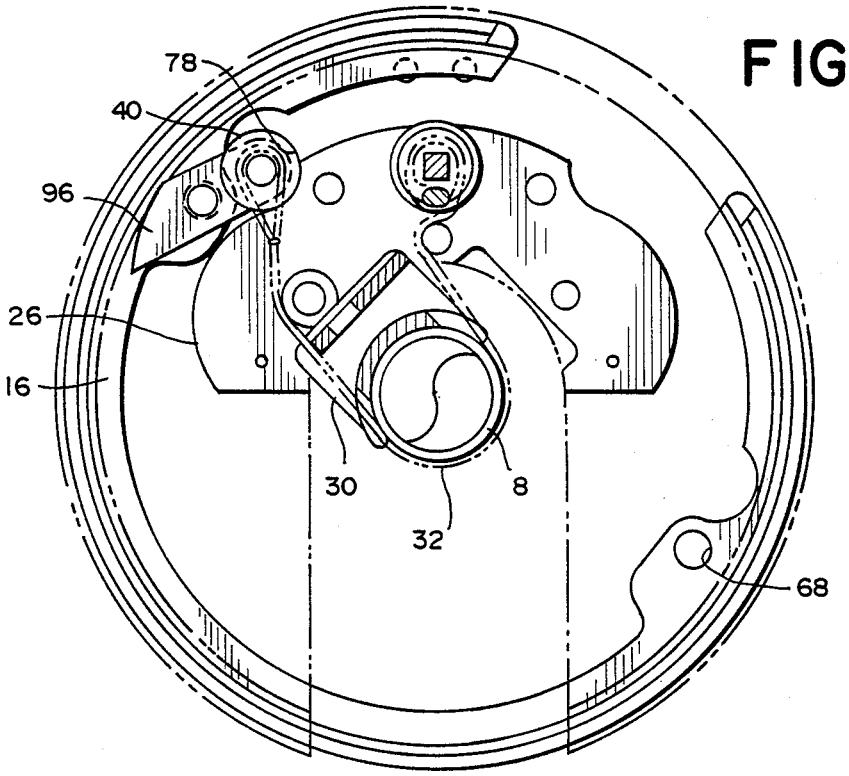

As shown in FIG. 6, upon further clockwise rotation of the rotary 16, the cam bearings 40 have been received in, stopped in, and are being held by cam nesting surfaces 78. The belt 32 is tightly wrapped around the pipe 8 and the pivot arms 34, 36 have pivoted as the belt has tightened. The rotary 16 cannot move further unless it moves the belt carrier assembly 31 and the belt anchor assembly 21 with it, thereby rotating the pipe 8 around which the belt 32 is wrapped. As shown in FIGS. 3–6 the belt carrier assembly 31 is so configured and so positioned in the housing that its end 96 contacts the housing to prevent inward movement of the end of the assembly having the cam bearings 42. Tightening of the belt serves to secure the key 56 in place between the recesses 52–54.

Once the apparatus has achieved a configuration as shown in FIG. 6, a bolt or shaft can be inserted through a hole 68 which extends through the rotary and into corresponding holes (not shown) in the brake plates 18, 20 thereby permitting reversal of the tong to rotate the pipe in a direction opposite to that in which it was previously rotated. This is more efficient than removing the belt carrier assembly from its mounting with pin 38 through hole 74 and then emplacing it over hole 68 and inserting the pin 38 therein (although this mode is within the scope of this invention).

To one of skill in this art who has the benefits of this invention's teachings it will be clear that adjustment of the braking means of the tong and adjustment of the belt length can affect the point at which the tong first begins to rotate a tubular; i.e., depending on these adjustments tubular rotation can be effected: when the bearings 40 contact any desired portion of the cam surfaces 26; when the belt carrier assembly reaches any desired point in its rotation about the tubular; or when the cam bearings 40 have nested in the cam nesting surfaces 78. It should also be noted that entry of the cam bearings 40 into the cam nesting surfaces 78 does not result in a loosening of the belt 32 since the belt is being further tightened around the tubular, pipe 8, and the spacer bolts 58 when the cam bearings 40 enter the nesting surfaces 78.

Reference herein to a belt made of flexible material refers, in preferred embodiments, to aramid fiber of KEVLAR (TM) belts useful with premium tubulars, softer metals, and softer materials such as fiberglass. However, it is within the scope of this invention to use a tong according to this invention with relatively hard tubulars, e.g. hard metal pipe or casing, and to employ for such uses a flexible material such as a properly configured belt made from metal chain links.

It will also be clear to one of skill in this art who has the benefits of this invention's teachings that it is within the scope of this invention to extend the high friction material 64 outwardly from the jaw 30 to encompass more of the pipe 8. In such a configuration the high friction material would be between the pipe 8 and the belt 32 when the belt wraps around the pipe. Furthermore, as shown in FIG. 6, the belt does not wrap completely around the pipe 8, but with suitable disposition of idler shafts, e.g. shaft 62, more (or less) of the belt can be disposed to contact the pipe (or an intermediate friction member).

Thus, it is seen that the apparatuses and methods of the present invention readily achieve the ends and advantages mentioned as well as other inherent therein. While certain preferred embodiments of the present invention have been described and illustrated for the purpose of disclosure, it will be clear to one of skill in this art who has the benefits of this invention's teachings that changes in the arrangement and construction of parts and steps may be made which changes are embodied within the spirit and scope of the present invention as claimed below. It is intended that each element or step recited in any of the following claims and each combination of elements is to be understood as referring to all equivalent elements or equivalent combinations for accomplishing substantially the same results in substantially the same or equivalent manner.

What is claimed is:

1. Belt assembly for a tong for rotating a tubular member, said tong having a housing with opening means therein for receiving the tubular member and a rotary element rotatably mounted within the housing, the belt assembly comprising mount means for mounting an anchor means, the mount means movably disposed within the housing adjacent to and movable with and with respect to the rotary element, jaw means secured to the anchor means, the jaw means for holding the tubular member and centering it in the tong, belt carrier means for carrying a belt means, the best carrier means mounted to the rotary element, the anchor means for anchoring the belt means, the anchor means mounted to the mount means, the anchor means having a body with exterior cam surface means, the belt means for wrapping around the tubular member, said belt means mounted about the anchor means and extending to and mounted about the belt carrier means, the rotary element with the belt carrier means rotatable around the tubular member to wrap the belt means around the tubular member, cam follower means movably connected to the belt carrier means for following the exterior cam surface means of the anchor means to facilitate wrapping the belt means around the tubular member, and the rotary element, belt carrier means, anchor means and belt means movable together to rotate the tubular member.

2. The belt assembly of claim 1 wherein the exterior cam surface means of the anchor means includes a nesting surface for receiving the cam follower means.

3. The belt assembly of claim 2 wherein the nesting surface prevents the cam follower means from proceeding past the nesting surface.

4. The belt assembly of claim 1 including also belt holding means comprising a main shaft secured to the anchor means, the main shaft having a top flange and a bottom flange secured thereto, both the top flange and bottom flange having a key recess therein, the key recesses in substantial alignment so that a loop at one end of a belt means disposed adjacent the main shaft can be positioned in alignment with the key recesses so that a key can be inserted through the loop and into the top flange's key recess and into the bottom flange's key recess to secure the belt holding means.

5. The belt assembly of claim 4 wherein the main shaft is rotatable with respect to the anchor means so that after insertion of the key, the main shaft and key can be rotated to tighten the belt and secure the key in place.

6. Belt assembly for a tong for rotating a tubular member, said tong having a housing with opening means therein for receiving the tubular member and a rotary element rotatably mounted within the housing, the belt assembly comprising mount means for mounting an anchor means, the mount means movably disposed within the housing adjacent to and movable with and with respect to the rotary element, jaw means secured to the anchor means, the jaw means for holding the tubular member and centering it in the tong, belt carrier means for carrying a belt means, the belt carrier means mounted to the rotary element, the anchor means for anchoring the belt means, the anchor means mounted to the mount means, the anchor means having a body with exterior cam surface means, the belt means for wrapping around the tubular member, said belt means mounted about the anchor means and extending to and mounted about the belt carrier means, the rotary element with the belt carrier means rotatable around the tubular member to wrap the belt means around the tubular member, cam follower means movably connected to the belt carrier means for following the exterior cam surface means of the anchor means to facilitate wrapping the belt means around the tubular member, the rotary element, belt carrier means, anchor means and belt means movable together to rotate the tubular member, and the exterior cam surface means of the anchor means including a nesting surface for receiving the cam follower means, the nesting surface preventing the cam follower means from proceeding past the nesting surface.

7. Belt assembly for a tong for rotating a tubular member, said tong having a housing with opening means therein for receiving the tubular member and a rotary element rotatably mounted within the housing, the belt assembly comprising mount means for mounting an anchor means, the mount means movably disposed within the housing adjacent to and movable with and with respect to the rotary element, belt carrier means for carrying a belt means, the belt carrier means mounted to the rotary element, the anchor means for anchoring the belt means, the anchor means mounted to the mount means, the anchor means having a body with exterior cam surface means, the belt means for wrapping around the tubular member, said belt means mounted about the anchor means and extending to and mounted about the belt carrier means, the rotary element with the belt carrier means rotatable around the tubular member to wrap the belt means around the tubular member, cam follower means movably connected to the belt carrier means for following the exterior cam surface means of the anchor means to facilitate wrapping the belt means around the tubular member, the rotary element, belt carrier means, anchor means and belt means movable together to rotate the tubular member, and belt holding means comprising a main shaft secured to the anchor means, the main shaft having a top flange having a key recess therein, the key recesses in substantial alignment so that a loop at one end of a belt means disposed adjacent the main shaft can be positioned in alignment with the key recesses so that a key can be inserted through the loop and into the top flange's and bottom flange's key recesses to secure the belt means to the belt holding means.

8. Belt assembly for a tong for rotating a tubular member, said tong having a housing with opening means therein for receiving the tubular member and a rotary element rotatably mounted within the housing, the belt assembly comprising mount means for mounting an anchor means, the mount means movably disposed within the housing adjacent to and movable with and with respect to the rotary element, belt carrier means for carrying a belt means, the belt carrier means mounted to the rotary element, the anchor means for anchoring the belt means, the anchor means mounted to the mount means, the anchor means having a body with exterior cam surface means, the belt means for wrapping around the tubular member, said belt means mounted about the anchor means and extending to and mounted about the belt carrier means, the rotary element with the belt carrier means rotatable around the tubular member to wrap the belt means around the tubular members, cam follower means movably connected to the belt carrier means for following the exterior cam surface means of the anchor means to facilitate wrapping the belt means around the tubular member, the rotary element, belt carrier means, anchor means and belt means movable together to rotate the tubular member, the exterior cam surface means of the anchor means including a nesting surface for receiving the cam follower means, the nesting surface preventing the cam follower means from proceeding past the nesting surface, belt holding means comprising a main shaft secured to the anchor means, the main shaft having a top flange and a bottom flange secured thereto, both the top flange and bottom flange having a key recess therein, the key recesses in substantial alignment so that a loop at one end of a belt means disposed adjacent the main shaft can be positioned in alignment with the key recesses so that a key can be inserted through the loop and into the top flange's key recess and into the bottom flange's key recess to secure the belt means to the belt holding means, the main shaft is rotatable with respect to the anchor means so that after insertion of the key, the main shaft and key can be rotated to tighten the belt and secure the key in place.

9. Belt holding apparatus for a tong having a belt assembly for rotating a tubular member, said tong having a housing with opening means therein for receiving the tubular member and a rotary element rotatably mounted within the housing, the belt assembly having mounted means for mounting an anchor means, the mount means movably disposed within the housing adjacent to and movable with and with respect to the rotary element, belt carrier means for carrying a belt means, the belt carrier means mounted to the rotary element, the anchor means for anchoring the belt means, the anchor means mounted to the mount means, the anchor means having a body with exterior cam surface means, the belt means for wrapping around the tubular member, said belt means mounted about the anchor means and extending to and mounted about the belt carrier means, the rotary element with the belt carrier means rotatable around the tubular member to wrap the belt means around the tubular member, cam follower means movably connected to the belt carrier means for following the exterior cam surface means of the anchor means to facilitate wrapping the belt means around the tubular member, the rotary element, belt carrier means, anchor means and belt means movable together to rotate the tubular member, the belt holding means comprising a main shaft secured to the anchor means, the main shaft having a top flange and a bottom flange secured thereto, both the top flange and bottom flange having a key recess therein, the key recesses in substantial alignment so that a loop at one end of a belt means disposed adjacent the main shaft can be positioned in alignment with the key recesses so that a key can be inserted through the loop and into the top flange's key recess and into the bottom flange's key recess to secure the key in place and to secure the belt means to the belt holding means.

10. The belt holding apparatus of claim 9 wherein the main shaft is rotatable with respect to the anchor means so that after insertion of the key, the main shaft and key can be rotated to tighten the belt and secure the key in place.

11. Tong apparatus for rotating a tubular member, said tong apparatus including, tong housing means, opening means in the tong housing means for receiving the tubular member to be rotated, rotary element means rotatably mounted to the housing means, and belt assembly means, the belt assembly means comprising mount means for mounting an anchor means, the mount means movably disposed within the housing adjacent to and movable with and with respect to the rotary element means, jaw means secured to the anchor means, the jaw means for holding the tubular member and centering it in the tong, belt carrier means for carrying a belt means, the belt carrier means mounted to the rotary element means, the anchor means for anchoring the belt means, the anchor means mounted to the mount means, the anchor means having a body with exterior cam surface means, belt means for wrapping around the tubular member, said belt means mounted about the anchor means and extending to and mounted about the belt carrier means, the rotary element means with the belt carrier means rotatable around the tubular member to wrap the belt means around the tubular member, cam follower means movably connected to the belt carrier means for following the exterior cam surface means of the anchor means to facilitate wrapping the belt means around the tubular member, the rotary element means, belt carrier means, anchor means and belt means movable together to rotate the tubular member, and drive means for moving the rotary element means.

12. Tong apparatus for rotating a tubular member, said tong apparatus including, tong housing means, opening means in the tong housing means for receiving the tubular member to be rotated, rotary element means rotatably mounted to the housing means, and belt assembly means, the belt assembly means comprising mount means for mounting an anchor means, the mount means movably disposed within the housing adjacent to and movable with and with respect to the rotary element means, jaw means secured to the anchor means, the jaw means for holding the tubular member and centering it in the tong, belt carrier means for carrying a belt means, the belt carrier means mounted to the rotary element means, the anchor means for anchoring the belt means, the anchor means mounted to the mount means, the anchor means having a body with exterior cam surface means, belt means for wrapping around the tubular member, said belt means mounted about the anchor means and extending to and mounted about the belt carrier means, the rotary element means with the belt carrier means rotatable around the tubular member to wrap the belt means around the tubular member, cam follower means movably connected to the belt carrier means for following the exterior cam surface means of the anchor means to facilitate wrapping the belt means around the tubular member, the rotary element means, belt carrier means, anchor means and belt means movable together to rotate the tubular member, the exterior cam surface means of the anchor means including a nesting surface for receiving the cam follower means, the nesting surface preventing the cam follower means from proceeding past the nesting surface, and drive means for moving the rotary element means.

13. Tong apparatus for rotating a tubular member, said tong apparatus including, tong housing means, opening means in the tong housing means for receiving the tubular member to be rotated, rotary element means rotatably mounted to the housing means, and belt assembly means, the belt assembly means comprising mount means for mounting an anchor means, the mount means movably disposed within the housing adjacent to and movable with and with respect to the rotary element means, belt carrier means for carrying a belt means, the belt carrier means mounted to the rotary element means, the anchor means for anchoring the belt means, the anchor means mounted to the mount means, the anchor means having a body with exterior cam surface means, belt means for wrapping around the tubular member, said belt means mounted about the anchor means and extending to and mounted about the belt carrier means, the rotary element means with the belt carrier means rotatable around the tubular member to wrap the belt means around the tubular member, cam follower means movably connected to the belt carrier means for following the exterior cam surface means of the anchor means to facilitate wrapping the belt means around the tubular member, the rotary element means, belt carrier means, anchor means and belt means movable together to rotate the tubular member, and belt holding means comprising a main shaft secured to the anchor means, the main shaft having a top flange and a bottom flange secured thereto, both the top flange and bottom flange having a key recess therein, the key recesses in substantial alignment so that a loop at one end of a belt means disposed adjacent the main shaft can be positioned in alignment with the key recesses so that a key can be inserted through the loop and into the top flange's key recess and into the bottom flange's key recess to secure the belt means to the belt holding means, and drive means for moving the rotary element means.

14. A belt assembly for a tong, the tong suitable for rotating a tubular member, the tong having a housing with an opening therein for receiving the tubular member and a rotary assembly rotatably mounted within the housing, the rotary assembly rotatable in combination with the belt assembly for rotating the tubular member, the tong having brake plates disposed on the rotary assembly and braking means for acting on the brake plate means to provide braking action on the brake plates, the belt assembly comprising an anchor member secured to the brake plates, the anchor member having an exterior cam surface, a jaw secured to the anchor member for holding and centering the tubular member, a belt carrier pivotably mounted to the rotary assembly and having a cam follower for contacting and following the cam surface of the anchor member, a belt made of flexible material mounted about the anchor member and extending to and secured to the belt carrier, and the rotary assembly rotatable around the tubular member to bring the cam follower into contact with the cam surface of the anchor member to wrap the belt around a portion of the tubular member, the rotary assembly rotatable with the anchor member, the brake plates, and the belt assembly to rotate the tubular member.

15. A belt assembly for a tong, the tong suitable for rotating a tubular member, the tong having a housing with an opening therein for receiving the tubular member and a rotary assembly rotatably mounted wihtin the housing, the rotary assembly rotatable in combination with the belt assembly for rotating the tubular member, the tong having brake plates disposed on the rotary assembly and braking means for acting on the brake plate means to provide braking action on the brake plates, the belt assembly comprising an anchor means secured to the brake plates, the anchor member having an exterior cam surface, a jaw secured to the anchor member for holding and centering the tubular member, a belt carrier pivotably mounted to the rotary assembly and having a cam follower for contacting and following the exterior cam surface of the anchor member, a belt made of flexible material mounted about the anchor member and extending to and secured to the belt carrier, the rotary assembly rotatable around the tubular member to bring the cam follower into contact with the exterior cam surface of the anchor member to wrap the belt around a portion of the tubular member, the rotary assembly rotatable with the anchor member, the brake plates, and the belt assembly to rotate the tubular member, and the exterior cam surface of the anchor member including a nesting surface for receiving the cam follower means, the nesting surface preventing the cam follower means from proceeding past the nesting surface.

16. A belt assembly for a tong, the tong suitable for rotating a tubular member, the tong having a housing with an opening therein for receiving the tubular member and a rotary assembly rotatably mounted within the housing, the rotary assembly rotatable in combination with the belt assembly for rotating the tubular member, the tong having brake plates disposed on the rotary assembly and braking means for acting on the brake plate means to provide braking action on the brake plates, the belt assembly comprising an anchor member secured to the brake plates, the anchor member having an exterior cam surface, a belt carrier pivotably mounted to the rotary assembly and having a cam follower for contacting and following the cam surface of the anchor member, a belt made of flexible material mounted about the anchor member and extending to and secured to the belt carrier, the rotary assembly rotatable around the tubular member to bring the cam follower into contact with the cam surface of the anchor member to wrap the belt around a portion of the tubular member, the rotary assembly rotatable with the anchor member, the brake plates, and the belt assembly to rotate the tubular member, and belt holding means comprising a main shaft secured to the anchor means, the main shaft having a top flange and a bottom flange secured thereto, both the top flange and bottom flange having a key recess therein, the key recesses in substantial alignment so that a loop at one end of a belt means disposed adjacent the main shaft can be positioned in alignment with the key recesses so that a key can be inserted through the loop and into the top flange's key recess and into the bottom flange's key recess to secure the belt means to the belt holding means.

17. Tong apparatus for rotating a tubular member, said tong apparatus including, a tong housing, an opening in the tong housing for receiving the tubular member to be rotated, a rotary assembly rotatably mounted within the housing, brake plates disposed on the rotary assembly and braking means for acting on the brake plates to provide braking action on the brake plates, an anchor member having an exterior cam surface, a jaw secured to the anchor member for holding and centering the tubular member, a belt assembly comprising a belt carrier pivotably mounted to the rotary assembly and having a cam follower for following the cam surface of the anchor member, a belt made of flexible material for wrapping the tubular member, said belt mounted about the anchor member and extending to and secured to the belt carrier, and the rotary assembly with the belt carrier rotatable around the tubular member to bring the cam follower into contact with the cam surface of the anchor member to wrap the belt around a portion of the tubular member, the rotary assembly rotatable with the anchor member, the brake plates, and the belt assembly to rotate the tubular member, and drive means for moving the rotary assembly.

18. Tong apparatus for rotating a tubular member, said tong apparatus including, a tong housing, an opening in the tong housing for receiving the tubular member to be rotated, a rotary assembly rotatably mounted within the housing, brake plates disposed on the rotary assembly and braking means for acting on the brake plates to provide braking action on the brake plates, an anchor member having an exterior cam surface, a jaw secured to the anchor member for holding and centering the tubular member, a belt assembly comprising a belt carrier pivotably mounted to the rotary assembly and having a cam follower for following the exterior cam surface of the anchor member, a belt made of flexible material for wrapping around the tubular member, said belt mounted about the anchor member and extending to and secured to the belt carrier, the rotary assembly with the belt carrier rotatable around the tubular member to bring the cam follower into contact with the exterior cam surface of the anchor member to wrap the belt around a portion of the tubular member, the rotary assembly rotatable with the anchor member, the brake plates, and the belt assembly to rotate the tubular member, the exterior cam surface of the anchor member including a nesting surface for receiving the cam follower means, the nesting surface preventing the cam follower means from proceeding past the nesting surface, and drive means for moving the rotary assembly.

19. Tong apparatus for rotating a tubular member, said tong apparatus including, a tong housing, an opening in the tong housing for receiving the tubular member to be rotated, a rotary assembly rotatably mounted within the housing, brake plates disposed on the rotary assembly and braking means for acting on the brake plates to provide braking action on the brake plates, an anchor member having an exterior cam surface, a belt assembly comprising a belt carrier pivotably mounted to the rotary assembly and having a cam follower for following the cam surface of the anchor member, a belt made of flexible material for wrapping around the tubular member, said belt mounted about the anchor member and extending to and secured to the belt carrier, the rotary assembly with the belt carrier rotatable around the tubular member to bring the cam follower into contact with the cam surface of the anchor member to wrap the belt around a portion of the tubular member, the rotary assembly rotatable with the anchor member, the brake plates, and the belt assembly to rotate the tubular member, belt holding means comprising a main shaft secured to the anchor means, the main shaft having a top flange and a bottom flange secured thereto, both the top flange and bottom flange having a key recess therein, the key recesses in substantial alignment so that a loop at one end of a belt means disposed adjacent the main shaft can be positioned in alignment with the key recesses so that a key can be inserted through the loop and into the top flange's key recess and into the bottom flange's key recess to secure the belt means to the belt holding means, and drive means for moving the rotary assembly.

* * * * *